US006241564B1

(12) United States Patent
Chen et al.

(10) Patent No.: US 6,241,564 B1
(45) Date of Patent: Jun. 5, 2001

(54) CARRIER PLATE FOR FORMING A PLUG CONTACT

(75) Inventors: Hsiang-Ping Chen; Howard Ou Lee; Jason Tsai, all of Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/335,207

(22) Filed: Jun. 17, 1999

(30) Foreign Application Priority Data

Dec. 22, 1998 (TW) ..... 87221333

(51) Int. Cl.[7] ..... H01R 9/24
(52) U.S. Cl. ..... 439/885
(58) Field of Search ..... 439/885, 886, 439/507, 509, 188, 699, 620, 78, 80

(56) References Cited

U.S. PATENT DOCUMENTS 3,818,423 * 6/1974 McDnough ..... 439/885
5,217,388 * 6/1993 Brown ..... 439/455
5,299,941 * 4/1994 Ohashi ..... 439/78
5,813,883 * 1/1999 Luin ..... 439/637
5,860,821 * 1/1999 Pernet ..... 439/188
5,938,039 * 8/1999 Liu ..... 439/885
6,050,863 * 4/2000 Noda ..... 439/856

* cited by examiner

*Primary Examiner*—Brian Sircus
*Assistant Examiner*—J. F. Duverne
(74) *Attorney, Agent, or Firm*—Wei Te Chung

(57) ABSTRACT

A carrier plate for forming a plug contact of an electrical connector assembly includes a plurality of contacts (1) and carriers (2, 3) connecting the contacts together. Each contact forms a body (11) and several tails (12) extending from the body. Each body comprises an upper portion (13) and a lower portion (14) having the same shape. A hole (16; 16') is disposed in the upper and lower portions proximate the tails for guiding the carrier plate during a bending process and for inspecting the qualty of the contact after the bending process is complete. The carriers connect the tails together for facilitating manufacture of the contacts and reducing costs.

2 Claims, 4 Drawing Sheets

CARRIER PLATE FOR FORMING A PLUG CONTACT

BACKGROUND OF THE INVENTION

The present invention relates to a carrier plate, and especially to a carrier plate for forming a plug contact of an electrical connector.

A known carrier plate for forming a plug contact of an electrical connector assembly is shown in FIGS. 6 and 7. Carriers 5, 5' are provided at opposite ends of the contacts 6 proximate soldering portions 61 and mating portions 62 of the contacts 6, respectively. Dotted lines indicate where the carriers 5, 5' are to be separated from the contacts 6. To facilitate separation of the carrier 5' from the contacts 6, small grooves 7 are provided at the border between each contact 6 and the carrier 5'. Thus, the contacts are not securely contacted to the carrier 5' and may become inadvertently separated therefrom when an external force is exerted thereon.

When the carrier 5' is separated from the contacts 6, a burr 64 will be formed at a free end of the soldering portion 61 which may hinder insertion of the soldering portion 61 into a hole defined in a PC board (not shown). Additionally, the PC board may become damaged during insertion of the soldering portion 61 into the hole of the PC board. Moreover, since the carrier 5 is proximate the mating portion 62, the plating operation of the mating portions 62 becomes difficult and the region where the carrier 5 is separated from the contact 6 may become improperly deformed thereby deforming the shape of the mating portions 62 and adversely affecting the electrical capabilities thereof. Furthermore, each mating portion 62 comprises two symmetrical parts to be aligned with each other by means of a bending process. However, the two parts may become offset from each other thereby compromising the quality thereof.

BRIEF SUMMARY OF THE INVENTION

A main object of the present invention is to provide a carrier plate for forming a plug contact of an electrical connector assembly, wherein at least a hole is disposed through the contact for guiding the carrier plate during a plating process and for facilitating quality inspection after a bending process is performed.

Another object of the present invention is to provide a carrier plate for forming a plug contact of an electrical connector assembly whereby the contacts can be manufactured easily and economically without becoming separated from carriers thereof during manufacture.

Accordingly, a carrier plate for forming a plug contact of an electrical connector assembly in accordance with a preferred embodiment of the present invention comprises a plurality of contacts and carriers connecting the contacts together. Each contact includes a body and several tails extending from the body. Each body comprises an upper section and a lower section having the same shape. A hole is disposed in the upper and lower sections proximate the tails for guiding the carrier plate during a bending process and for inspecting the quality of the contact plate after the bending process is complete. The carriers connect the tails together for facilitating manufacture of the contacts and reducing costs.

Other objects, advantages and novel features of the invention will become more apparent from the following detailed description of the preferred embodiment when taken in conjunction with the accompanying drawings.

DETAILED DESCRIPTION OF THE INVENTION

Figure 2:
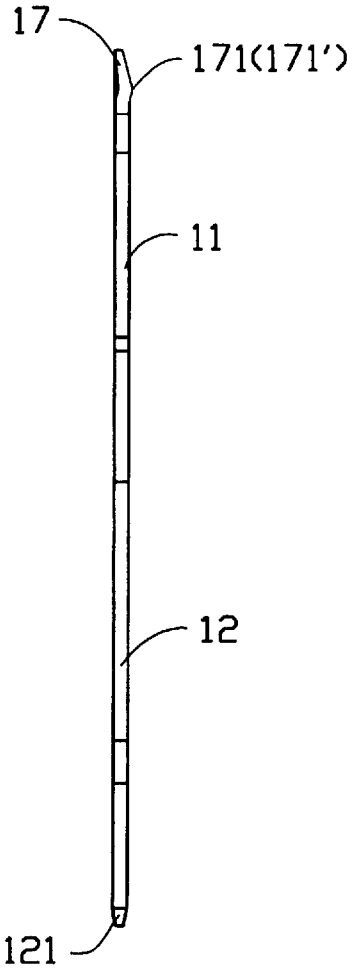
FIG. 2 is a side view of FIG. 1.
Figure 1:
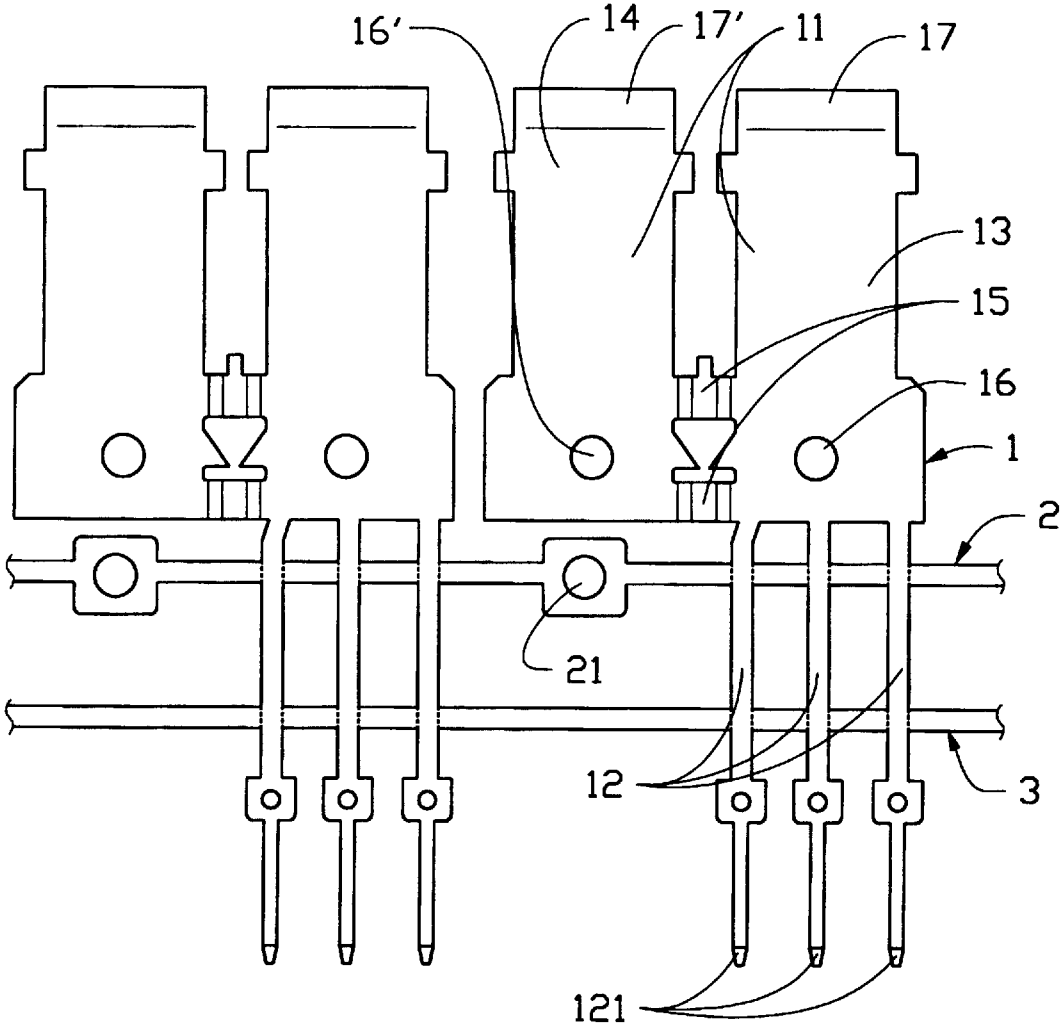
FIG. 1 is a front view of a carrier plate for forming a plug contact of an electrical connector assembly in accordance with a preferred embodiment of the present invention.

Referring to FIGS. 1 and 2, the carrier plate for forming a plug contact of an electrical connector assembly includes a plurality of contacts 1, a first carrier 2 and a second carrier 3, wherein each contact 1 comprises a body 11 and several tails 12 extending therefrom. The body 11 includes an upper portion 13 and a lower portion 14 having the same shape. The upper portion 13 and the lower portion 14 are connected together by a pair of connecting portions 15 proximate the tails 12. Holes 16, 16' are disposed in the upper and lower portions 13, 14 for facilitating inspection of quality after a bending process is performed on the carrier plate. The upper portion 13 forms a mating portion 17 at a position opposite tails. Likewise, the lower portion 14 forms a mating portion 17' at a corresponding position. A contact region 171, 171' is formed between each upper and lower portion 13, 14 and the corresponding mating portion 17, 17'. The tails 12 of each contact 1 extend from an end of the upper portion 13 opposite the contact region 171 and form a pointed solder end 121 at each free end thereof. The first carrier 2 connects with the tails 12 proximate the upper portions 13, and the second carrier 3 connects with the tails 12 between the first carrier 2 and the solder ends 121. Guiding holes 21 are disposed in the first carrier 2 between sets of adjacent tails 12.

Since the first carrier 2 and the second carrier 3 are distanced from the contact regions 171, 171' and the solder ends 121, burrs will not be formed on the solder end 121 after the carriers 2, 3 are separated from the contact 1, thus the solder ends 121 can be easily inserted into corresponding holes of a PC board (not shown). In addition, the contact region 171 will not become deformed during separation.

Figure 4:
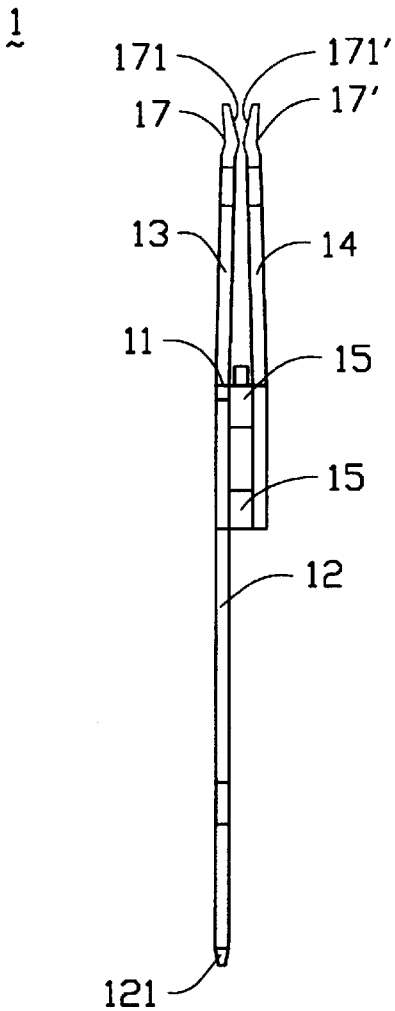
FIG. 4 is a side view of the FIG. 3.
Figure 3:
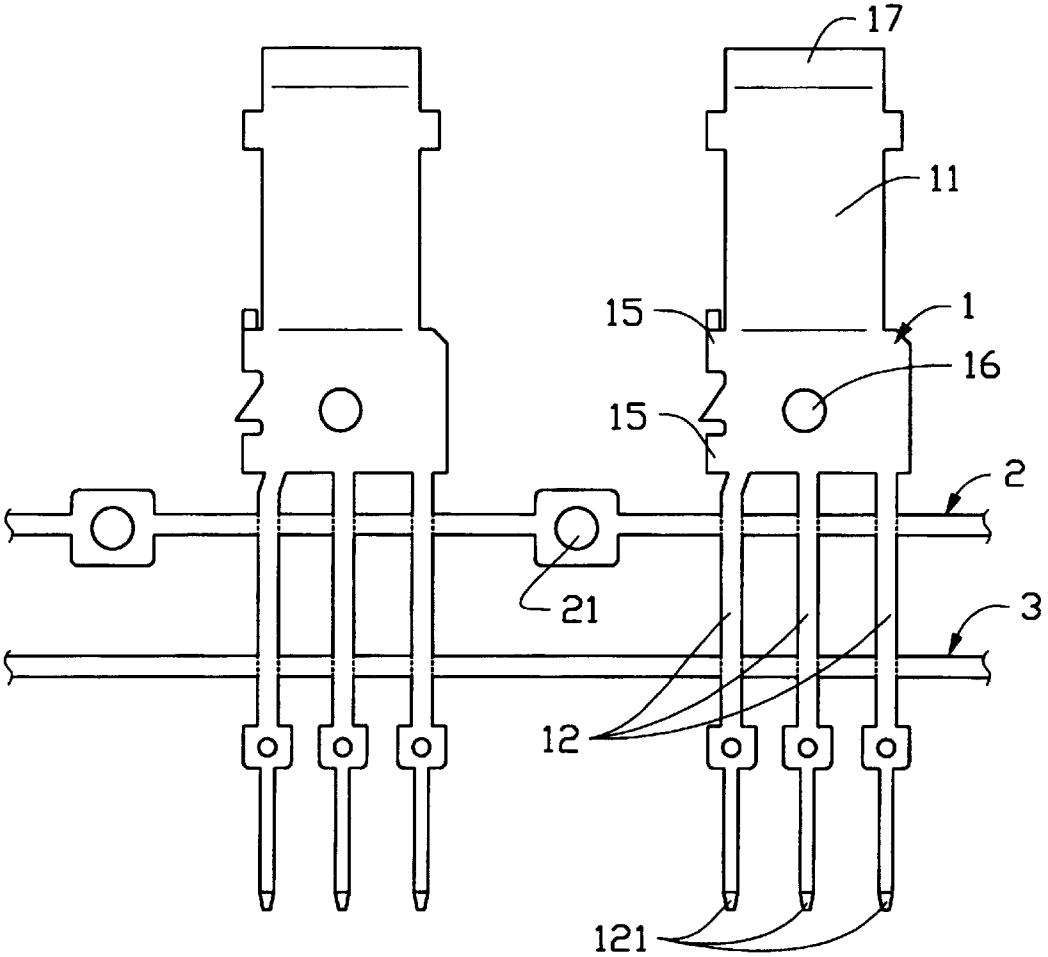
FIG. 3 is a front view of the carrier plate of the present invention after a bending process is performed thereon.

Referring to FIGS. 3 and 4, the broken lines indicate where the carriers 2, 3 are separated from the contacts 1. After the contacts 1 is plated and pressed, the upper and the lower portions 13, 14 of the contact 1 are bent to form the body 11. The upper portion 13 and the lower portion 14 are each bent approximately 90 degrees with respect to the contact portions 15 whereby the upper and the lower portions 13, 14 are aligned in parallel with each other and the contact regions 171, 171' are proximate each other.

Figure 5:
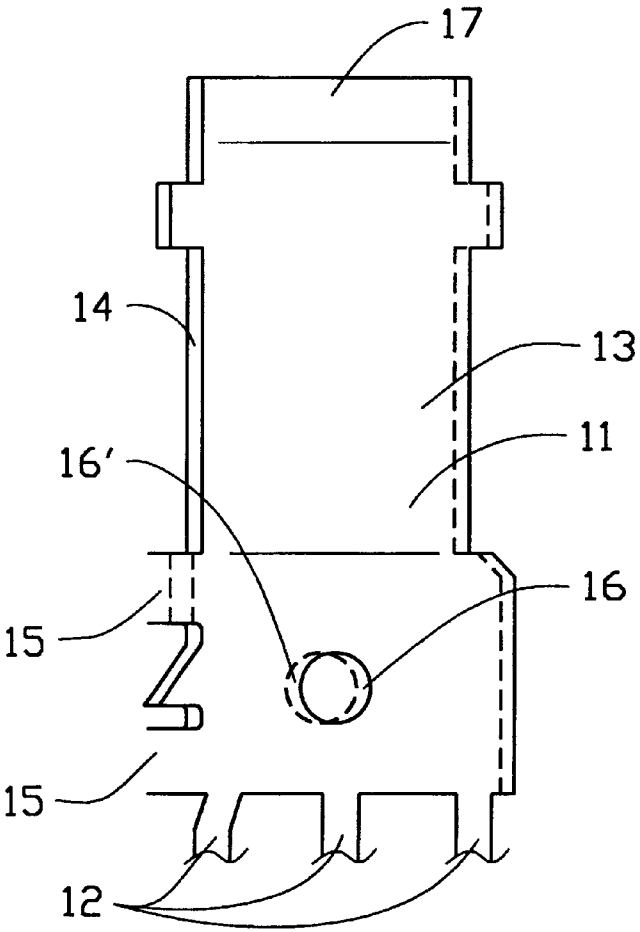
FIG. 5 is a partial view of the carrier plate depicting how the quality thereof can be inspected after the bending process is performed thereon.
Figure 7:
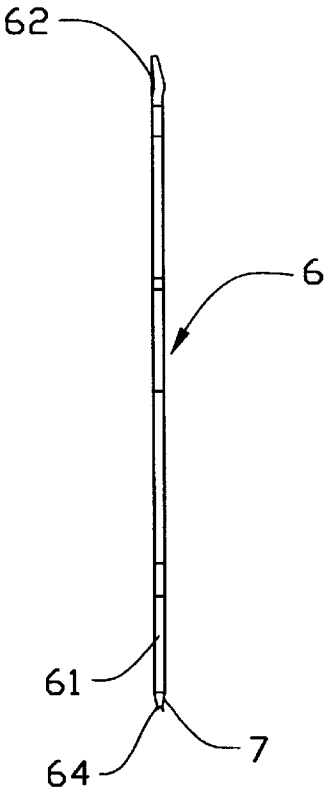
FIG. 7 (PRIOR ART)
FIG. 7 is a side view of FIG. 6 after carriers at opposite ends of the plug contact being cut off therefrom.
Figure 6:
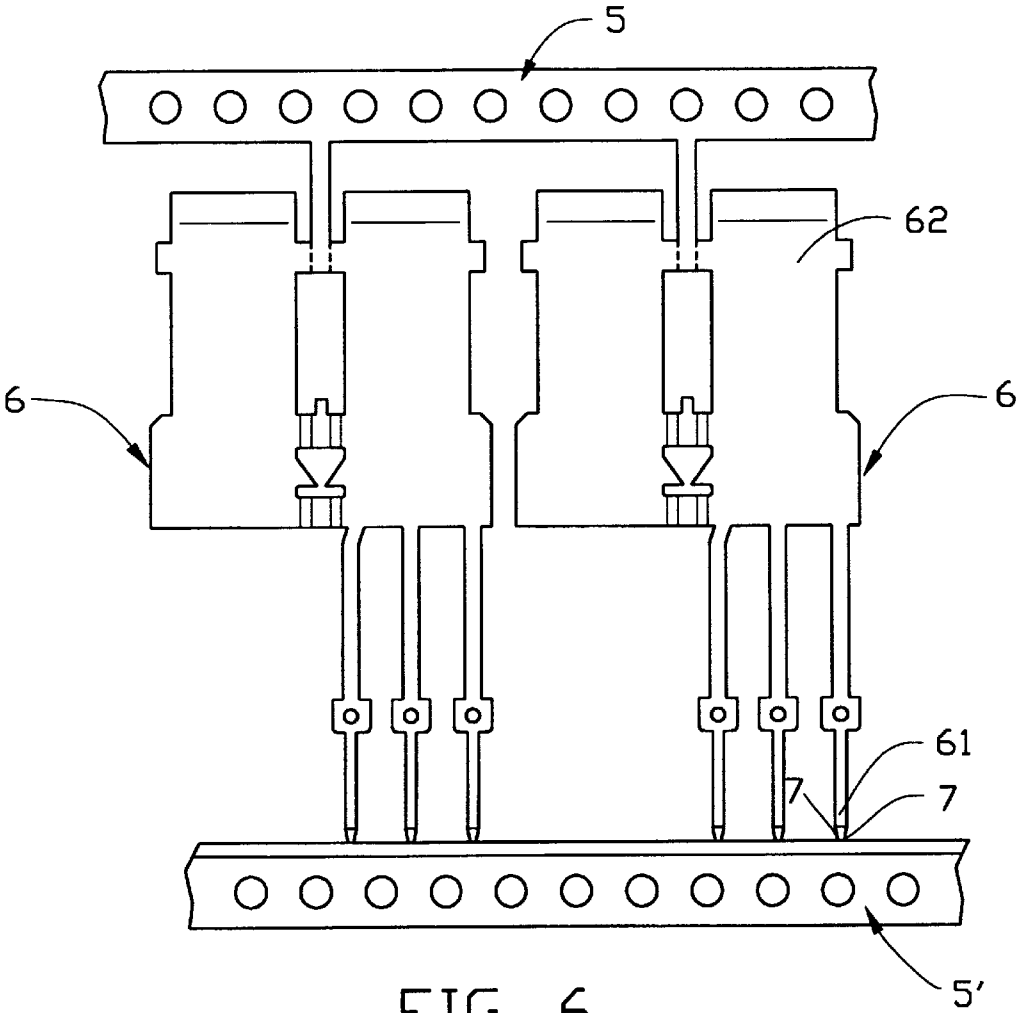
FIG. 6 (PRIOR ART)
FIG. 6 is a front view of a conventional carrier plate for forming a plug contact of an electrical connector assembly.

Referring to FIG. 5, to ensure that the upper and the lower portions 13, 14 are properly bent, quality can be easily inspected by checking that the holes 16 are in alignment.

It can be understood that in the invention, the hole 16 is formed in the contact itself, which not only can cooperate with another similar hole of the contact for inspecting/checking the precision of the final configuration of the contact, but also can function by itself as a guiding or holding device, similar to the guiding holes 21 in the first carrier 2, during the plating or installation/assembling process when the contact is still connected to the contact carrier.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A carrier plate for forming plug contacts of an electrical connector assembly, each plug contact having two contacting sections parallel with each other for sandwiching a terminal of a complementary connector therebetween, the carrier plate comprising:

a series of contacts each including at least one tail, an upper portion and a lower portion symmetrically formed for forming the contacting sections of each plug contact, and a connecting portion intermediate the upper and lower portions;

a hole formed in each of said upper portion and lower portion for inspecting alignment of the upper portion and lower portion with respect to each other when the upper and lower potions are bent along the connecting portions to form the contacting sections of the plug contact; and a first and a second carriers connected to the tails at positions away from solder ends of the tails; wherein a protruding contact region is formed proximate an end of each of said upper and lower portions; and wherein the at least one tail extends from an end of one of the upper and lower portions opposite the contact region.

2. The carrier plate as claimed in claim 1, wherein the holes of the upper and the lower portions are aligned with each other after the upper and lower portions are bent along the connecting portion.

* * * * *